US011951528B2

(12) United States Patent
Fuesting et al.

(10) Patent No.: US 11,951,528 B2
(45) Date of Patent: Apr. 9, 2024

(54) CONTROLLED MICROSTRUCTURE FOR SUPERALLOY COMPONENTS

(71) Applicants: Rolls-Royce Corporation, Indianapolis, IN (US); Rolls-Royce North American Technologies, Inc., Indianapolis, IN (US)

(72) Inventors: Timothy Paul Fuesting, Indianapolis, IN (US); Gangshu Shen, Indianapolis, IN (US); Eugene Sun, Indianapolis, IN (US)

(73) Assignees: Rolls-Royce Corporation, Indianapolis, IN (US); Rolls-Royce North American Technologies, Inc., Indianapolis, IN (US)

( * ) Notice: Subject to any disclaimer, the term of this patent is extended or adjusted under 35 U.S.C. 154(b) by 148 days.

(21) Appl. No.: 17/445,454

(22) Filed: Aug. 19, 2021

(65) Prior Publication Data

US 2022/0055093 A1 Feb. 24, 2022

Related U.S. Application Data

(60) Provisional application No. 63/068,137, filed on Aug. 20, 2020.

(51) Int. Cl.
*B21J 1/06* (2006.01)
*B21J 5/00* (2006.01)
(Continued)

(52) U.S. Cl.
CPC ..... *B21J 1/06* (2013.01); *B21J 5/008* (2013.01); *B21J 5/02* (2013.01); *B21J 9/022* (2013.01);
(Continued)

(58) Field of Classification Search
CPC ..... B21J 1/06; B21J 9/022; B21J 5/02; B21J 5/008; B21K 3/04; B21K 1/28; C22C 19/05; C22C 19/056; C22F 1/10
See application file for complete search history.

(56) References Cited

U.S. PATENT DOCUMENTS 3,660,177 A 5/1972 Brown et al.
5,302,217 A 4/1994 Gostic et al.
(Continued)

OTHER PUBLICATIONS

Evolution of Microstructure and Mechanical Properties of ATI 718Plus Superalloy After Graded Solution Treatment, by Lech et al., Mechanical and Materials Transactions A, vol. 54A, May 2023, pp. 2011-2021 (Year: 2023).*
(Continued)

*Primary Examiner* — Moshe Wilensky
(74) *Attorney, Agent, or Firm* — Shumaker & Sieffert, P.A.

(57) ABSTRACT

The disclosure describes example systems and techniques for controlling microstructure of a superalloy substrate by controlling temperature during forging and using multiple die forging stages to formation of grain boundary phases of the superalloy, and components formed by such example systems and techniques. The method includes heating a substrate to within a forging temperature range. The substrate includes a nickel-based superalloy, and the forging temperature range is below an eta phase solvus temperature of the substrate. The method includes applying a plurality of die forging stages to the substrate to form a component preform. The method includes maintaining the substrate within the forging temperature range during application of the plurality of die forging stages and cooling the component preform.

10 Claims, 10 Drawing Sheets

(51) Int. Cl.

| | |
|---|---|
| ***B21J 5/02*** | (2006.01) |
| ***B21J 9/02*** | (2006.01) |
| ***B21K 3/04*** | (2006.01) |
| ***C22C 19/05*** | (2006.01) |
| ***C22F 1/10*** | (2006.01) |

(52) U.S. Cl.
CPC ..... *B21K 3/04* (2013.01); *C22C 19/056* (2013.01); *C22F 1/10* (2013.01)

(56) References Cited

U.S. PATENT DOCUMENTS

| | | | | |
|---|---|---|---|---|
| 5,693,159 | A | 12/1997 | Athey et al. | |
| 2016/0215369 | A1 | 7/2016 | Helmink | |
| 2018/0100223 | A1* | 4/2018 | Kobayashi | C22C 19/056 |
| 2020/0056275 | A1* | 2/2020 | Ota | B21K 3/04 |

OTHER PUBLICATIONS

Silva et al., "Characterization of alloy 718 subjected to different thermomechanical treatments", Materials Science and Technology, Oak Ridge National Laboratory, Retrieved Jul. 2020, 17 pgs.
Lyu et al., "The S Phase Precipitation of an Inconel 718 Superalloy Fabricated by Electromagnetic Stirring Assisted Laser Solid Forming", Aug. 2019, 16 pgs.
Enz et al., "Design of an Eta-Phase Strengthened Nickel-Based Alloy", Michigan Technological University Senior Design Project Report, Jun. 15, 2013, 39 pgs.
Hassan et al., "Effect of Strain Hardening on Precipitation Kinetics in ATI 718Plus", University of Strathclyde, Advanced Forming Research Centre, Retrieved Jul. 2020, 7 pgs.
McDevitt, "Effect of Temperature and Strain During Forging on Subsequent Delta Phase Precipitation During Solution Annealing in ATI 718Plus Alloy", TMS (The Minerals, Metals & Materials Society) 2010, 13 pgs. (Applicant points out, in accordance with MPEP 609.04(a), that the year of publication, 2010, is sufficiently earlier than the effective U.S. filing date, so that the particular month of publication is not in issue.).
Lee et al., "Fine Grains Forming Process, Mechanism of Fine Grain Formation and Properties of Superalloy 718", Materials Transactions, vol. 53, No. 4 (2012) pp. 716 to 723, Feb. 2012, 8 pgs.
Hassan et al., "Grain boundary precipitation in Inconel 718 and ATI 718Plus", Materials Science and Technology, Jun. 2017, 12 pgs.
Yamaguchi et al., "Grain Size Prediction of Alloy 718 Billet Forged by Radial Forging Machine Using Numerical and Physical Simulation", TMS (The Minerals, Metals & Materials Society) 2001, 10 pgs. (Applicant points out, in accordance with MPEP 609.04(a), that the year of publication, 2001, is sufficiently earlier than the effective U.S. filing date, so that the particular month of publication is not in issue.).
Lalvani, "Hot Deformation of IN718 with Various Initial Microstructures—Experiments and State-variable Modeling", PhD thesis, The Open University, 2010, 265 pgs. (Applicant points out, in accordance with MPEP 609.04(a), that the year of publication, 2010, is sufficiently earlier than the effective U.S. filing date, so that the particular month of publication is not in issue.).
Lalvani et al., "Hot Forging of IN718 with Solution-Treated and Delta-Containing Initial Microstructures", Metallogr. Microstruct. Anal. (2016) 5:392-401, Jul. 2016, 10 pgs.
Jeniski Jr. et al., "Nickel-Base Superalloy Designed for Aerospace", Advanced Materials & Processes, Dec. 2006, 4 pgs.
Smith et al., "Phase transformation strengthening of high-temperature superalloys", Nature Communications, Nov. 2016, 7 pgs.

* cited by examiner

CONTROLLED MICROSTRUCTURE FOR SUPERALLOY COMPONENTS

This application claims the benefit of U.S. Provisional Application Ser. No. 63/068,137 filed Aug. 20, 2020, the entire contents of which is incorporated herein by reference.

TECHNICAL FIELD

The present disclosure generally relates to techniques and systems for forming superalloy components.

BACKGROUND

Hot forging may be used to form alloy components. During hot forging, an alloy component may be heated at or above a forging temperature to soften the component and worked to change a shape of the alloy component. As a result of forging, the alloy component may have a non-homogeneous microstructure caused by the forging temperature and the forces exerted on the alloy component during forging.

SUMMARY

The disclosure describes example systems and techniques for controlling microstructure of an alloy substrate by controlling temperature during forging and using multiple forging stages with different die to control formation of grain boundary phases of the superalloy, and components formed by such example systems and techniques.

In some examples, the disclosure describes an example method that includes heating a substrate to within a forging temperature range. The substrate includes a nickel-based superalloy, and the forging temperature range is below an eta phase solvus temperature of the substrate. The method includes applying a plurality of die forging stages to the substrate to form a component preform. The method includes maintaining the substrate within the forging temperature range during application of the plurality of die forging stages and cooling the component preform after completing the plurality of die forging stages.

In some examples, the disclosure describes a system including a plurality of sequential forging dies configured to form a component preform from a substrate. The substrate includes an alloy or superalloy. The system includes a forging press configured to apply the plurality of sequential forging dies in a plurality of die forging stages. The system includes a heat source configured to heat the substrate to within a forging temperature range and maintain the substrate within the forging temperature range during application of the plurality of die forging stages. The forging temperature range is below a transition temperature of the substrate. The system may include a cooling source configured to cool the component preform after completing the plurality of die forging stages, such as if geometry of the component requires.

In some examples, the disclosure describes a component including a nickel-based superalloy. A high stress portion of the component includes a relatively low delta phase region in which a volume fraction of a delta phase in the relatively low delta phase region is less than about 80% of an average volume fraction of the delta phase in the component.

The details of one or more examples are set forth in the accompanying drawings and the description below. Other features, objects, and advantages will be apparent from the description and drawings, and from the claims.

DETAILED DESCRIPTION

The disclosure describes example systems and techniques for controlling microstructure of a nickel-based superalloy by controlling temperature during hot forging and using multiple die forging stages to refine grain size and control formation of grain boundary phases of the superalloy, and components formed by such example systems and techniques.

High temperature components of gas turbine engines, such as high pressure discs and impellers, may be formed from precipitation-hardened nickel-based superalloys. The microstructure of such superalloys may be designed to increase strength, low cycle fatigue performance, and/or resistance to fatigue crack growth and creep deformation. Nickel-based superalloys may be alloyed with refractory elements and heat-treated to precipitate a high volume fraction of strengthening phases, such as gamma prime (γ') and double prime (γ") phases, in an austenitic face centered cubic (fcc) matrix. For example, a nickel-based superalloy that includes various combinations of niobium, titanium, and/or aluminum may be strengthened by a gamma prime phase ($Ni_3Ti$ or $Ni_3Al$) and/or a gamma double prime ($Ni_3Nb$) phase. Nickel-based superalloys may also be hot forged under high loads and at high temperatures to refine grains, such as by recrystallization and grain growth. In these various ways, a microstructure of nickel-based superalloys may be refined and controlled to produce improved mechanical properties.

Figure 2:
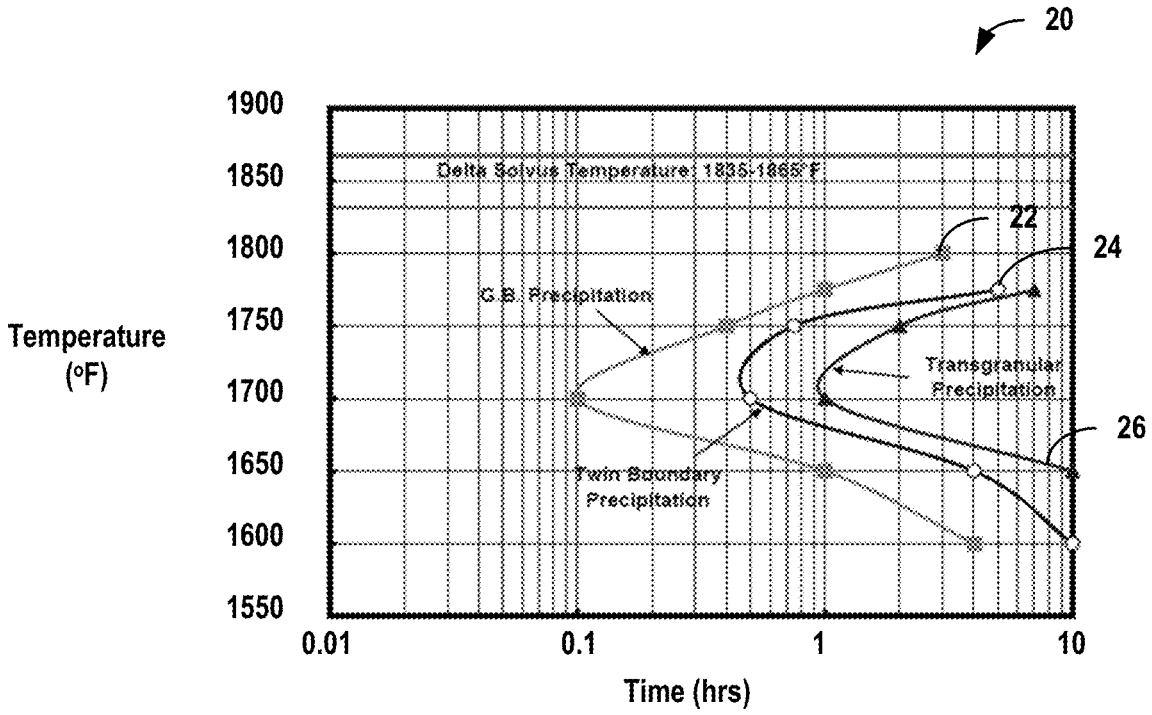
FIG. 2 is a time-temperature-transformation diagram of delta phase formation for Inconel 718+.

At certain processing conditions, nickel-based superalloys may also precipitate other phases, primarily at grain boundaries (i.e., grain boundary phases, though precipitation may occur at twin boundaries or between boundaries), which do not contribute to the strength of the superalloys. For example, a nickel-based superalloy containing niobium, titanium, and/or aluminum, such as 718Plus (718+), may form a delta phase ($Ni_3Nb$) or an eta phase ($Ni_3Ti$ and/or $Ni_3Al_{0.5}Nb_{0.5}$) when maintained at sub-solvus temperatures below the solvus temperature of the grain boundary phases and above the solvus temperatures of the strengthening phases, such as illustrated in FIG. 2 (for the delta phase) and described further below. The eta phase and delta phase may be relatively similar in composition, with a slight difference in crystal structure. As such, often formation of one boundary phase will trigger precipitation or growth of another boundary phase. The formation of the grain boundary phases may occur through precipitation or through transformation from other phases, such as from the gamma prime or double prime phases, when the superalloy is exposed to these sub-solvus temperatures.

In addition to temperature, other processing conditions, such as strain, may increase formation of the grain boundary phases. For example, an increase in residual strain during forging may correspond to an increase in precipitation of the eta phase. Strain or cold work modifies the alignment of the crystal structure of the many grains that make up the microstructure creating a preferred alignment or crystallographic texture. These highly aligned textures often enhance precipitation of secondary phases. Likewise, the alignment or texture tends to encourage the secondary growth in certain orientations thus creating alignment of the secondary phase precipitates. Residual stress also encourages or enhances the rate of nucleation and growth of these secondary phases. Therefore, a highly cold/warm worked structure (such as a forging done well into the subsolvus region) tends to have a high degree of crystallographic texture as well as the potential to have higher residual stresses. These conditions will tend to encourage precipitation and growth of aligned secondary phases such as eta and delta.

The grain boundary phases may have different crystal structures, such as orthorhombic for the delta phase or hexagonal closed pack for the eta phase, than the crystal structures of the matrix or strengthening phases (e.g., gamma, gamma prime, and gamma double prime phases), and a relatively large volume fraction of the grain boundary phases may result in degradation of mechanical properties, such as ductility, of the superalloy substrate. For example, nickel-based superalloy substrates subject to relatively high loads during thermomechanical processing, and thereby incurring large amounts of residual strain, may be particularly susceptible to formation of the eta phase. A component machined from a component preform having a relatively high volume fraction of grain boundary phases may have lower strength, ductility, and/or creep resistance than a component formed from a superalloy substrate having relatively low volume fraction of grain boundary phases.

According to examples described herein, an alloy component preform, such as a nickel-based superalloy component preform, may include a relatively uniform microstructure (i.e., grain boundary sizes) with a low volume fraction of grain boundary phases, such as the delta and/or eta phases. A nickel-based superalloy substrate may be heated to within a forging temperature range and subjected to multiple die forging stages to refine the grain size of the substrate and shape the substrate into a component preform from which a component may be machined. This forging temperature range may be at or below one or more grain boundary phase solvus temperatures and above intermediate temperatures at which transformation kinetics of the grain boundary phases may be relatively high. The superalloy substrate may be maintained within this forging temperature range during and between the multiple die forging stages to reduce precipitation of the grain boundary phases and quickly cooled to a low temperature to reduce precipitation and/or transformation of the delta and eta phases from the strengthening phases. In this way, the resulting component preform may include relatively uniform grain size and a relatively low volume fraction of the delta and/or eta phase.

In some examples, a nickel-based superalloy component preform may include a reduced volume fraction of delta and eta phases in particular portions or regions of the component preform. During forging, particular portions of the superalloy substrate may be maintained at relatively high forging temperatures to reduce formation of grain boundary phases, such as the delta and eta phases described above. The plurality of die forging stages applied to the superalloy substrate may be configured to refine the grain size through relatively high strain, while also forming the component preform to include low grain boundary phase regions at predetermined volumes within the component preform. When processing a component from the component preform, portions of the component that undergo higher and/or repeated stresses during operation, such as a bore of an impeller, may include the relatively low grain boundary phase regions of the component preform, while portions of the component that undergo lower stresses during operation, such as a rim of the impeller, may include relatively higher grain boundary phase regions. In this way, the microstructure of the component may be selectively controlled to provide improved mechanical properties to regions under higher amounts of stress.

Figure 1:
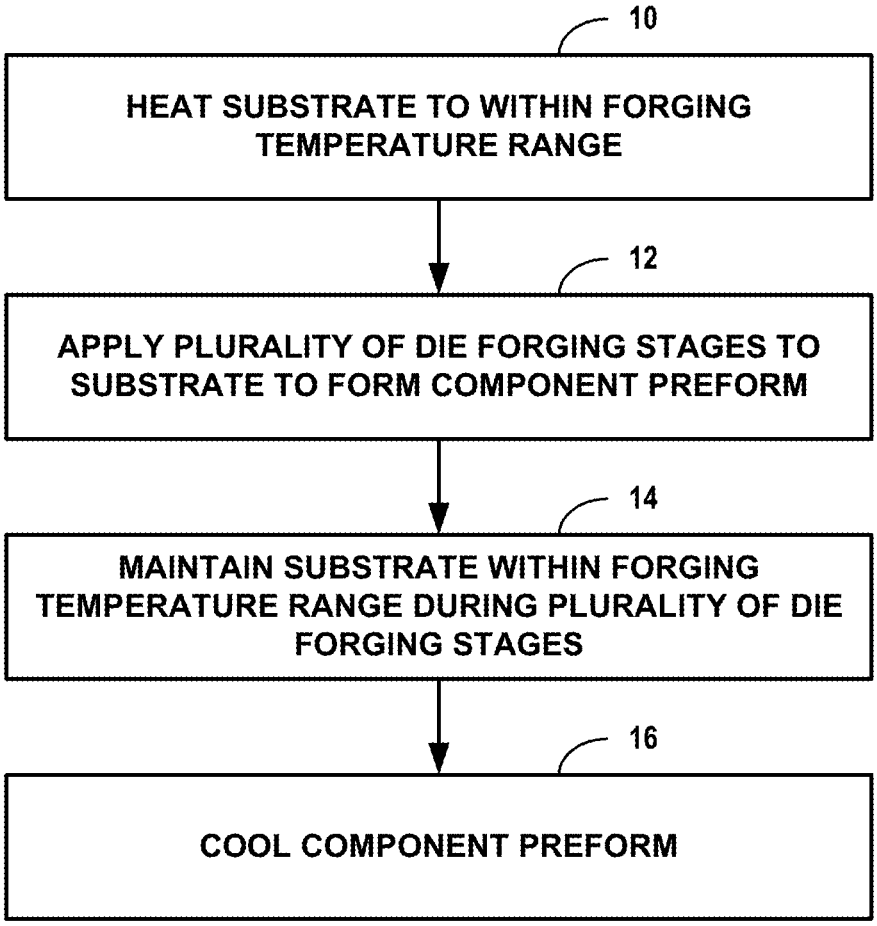
FIG. 1 is a flow diagram illustrating an example technique for controlling microstructure in a superalloy substrate.

FIG. 1 is a flow diagram illustrating an example technique for controlling microstructure in an alloy, such as a nickel-based superalloy, substrate during forging of a component preform. The component preform may represent a final stage of the superalloy substrate prior to machining of the superalloy substrate into a component. A variety of components may be formed from the superalloy substrates and technique described herein including, but not limited to, impellers, low pressure turbine discs, high pressure turbine discs, and the like.

The component preform may be formed from a superalloy substrate that includes a precipitation-hardened nickel-based superalloy. The precipitation-hardened nickel-based superalloy may include any alloy with a primary constituent (i.e., greater wt. % than any other constituent) of nickel forming a gamma phase face centered cubic (fcc) matrix and one or more alloying elements configured to precipitate one or more strengthening fcc phases. In some examples, the nickel-based superalloy may be a nickel-chromium-iron-based (NiCrFe) superalloy having a relatively high strength and corrosion resistance. In addition to nickel, the nickel-based superalloys may include other elements configured to reside in the gamma phase matrix including, but not limited to, cobalt, iron, chromium, molybdenum, tungsten, and other elements having a relatively similar atomic radii to nickel.

In addition to gamma phase components, the nickel-based superalloy substrate includes one or more components configured to precipitate one or more strengthening phases. For example, components having a relatively large atomic radii compared to nickel may encourage precipitation of relatively ordered phases, such as gamma prime (e.g., $Ni_3Ti$ or $Ni_3Al$) and/or gamma double prime (e.g., $Ni_3Nb$) phases. As described above, the gamma prime and/or gamma double prime phases may be configured to increase strength, low cycle fatigue performance, resistance to fatigue crack growth and creep deformation, and/or ductility of the superalloy substrate, in addition to other advantageous mechanical properties. In some examples, the nickel-based superalloy may include at least one of niobium, aluminum, titanium, and/or tantalum. In some examples, a relative concentration of aluminum to titanium may be selected to reduce precipitation of the delta and eta phases, such as by having a relatively high ratio of aluminum to titanium and/or including an aluminum and titanium concentration greater than about 3 wt. %. In some examples, the superalloy substrate may include between about 4 wt. % and about 8 wt. % niobium, between about 0.4 wt. % and about 2.6 wt. % aluminum, and between about 0.4 wt. % and about 1.4 wt. % titanium.

In some examples, the superalloy substrate may include other components selected to improve one or more properties of the superalloy substrate. As one example, the superalloy substrate may include chromium to increase resistance to oxidation and corrosion. In some examples, the superalloy substrate may include less than about 15 wt. % to reduce combination with refractory elements in the alloy and formation of topologically close-packed (TCP) phases. In some examples, the superalloy substrate may include cobalt to lower a gamma prime solvus and a stacking fault energy, which may aid in processability, creep rupture strength, and, at some temperatures, fatigue strength. In some examples, the superalloy substrate may include less than about 20 wt. % cobalt to reduce formation of grain boundary phases. In some examples, molybdenum and tungsten may act as solid solution strengtheners for both the gamma and gamma prime phases. In some examples, the superalloy substrate may include boron, carbon, and/or zirconium to strengthen the grain boundaries by forming nonmetallic particles at the grain boundaries and/or counteract the deleterious effects of grain impurity segregates like sulfur and oxygen by acting as a diffusion barrier. In some examples, the superalloy substrate may include hafnium and silicon to improve dwell fatigue and environmental resistance, respectively.

In some examples, the superalloy substrate may have a composition including between about 12 wt. % and about 20 wt. % chromium, between about 6 wt. % and about 14 wt. % iron, between about 5 wt. % and about 12 wt. % cobalt, between about 4 wt. % and about 8 wt. % niobium, less than about 6 wt. % tungsten, less than about 4 wt. % molybdenum, between about 0.6 wt. % and about 2.6 wt. % aluminum, between about 0.4 wt. % and about 1.4 wt. % titanium, less than about 0.1 wt. % carbon, between about 0.003 wt. % and about 0.03 wt. % phosphorus, and between about 0.003 and about 0.015 wt. % boron.

In some examples, the superalloy substrate may include Inconel 718Plus and/or alloy variants relatively similar in composition that are prone to form delta and eta phases. For example, the superalloy substrate may have a composition including between about 17 wt. % and about 21 wt. % chromium, between about 8 wt. % and about 10 wt. % iron, between about 8 wt. % and about 10 wt. % cobalt, between about 5.2 wt. % and about 5.8 wt. % niobium, between about 0.8 wt. % about 1.4 wt. % tungsten, between about 2.5 wt. % and about 3.1 wt. % molybdenum, between about 1.2 wt. % and about 1.7 wt. % aluminum, between about 0.5 wt. % and about 1 wt. % titanium, between about 0.01 wt. % and about 0.05 wt. % carbon, between about 0.004 wt. % and about 0.02 wt. % phosphorus, between about 0.003 and about 0.008 wt. % boron, less than about 0.35 wt. % manganese, less than about 0.35 wt. % silicon, less than about 0.0025 wt. % sulfur, less than about 0.3 wt. % copper, and less than about 0.0005 wt. % lead.

The method of FIG. 1 includes heating the superalloy substrate to within a forging temperature range (10). In some examples, the forging temperature range may be selected to increase grain refinement of the superalloy substrate. Grain refinement may include a reduction in grain size, a reorientation of grains, and other modifications to grains within the superalloy substrate that may improve mechanical properties of the superalloy substrate.

In some examples, and without being limited to any particular theory, grain refinement of the superalloy substrate may be achieved, at least partially, by precipitating a relatively small, distributed delta phase under high strain. These fine, precipitated delta phases may inhibit grain growth during recrystallization to obtain relatively fine, uniform grains, as will be described further below. The forging temperature range may be high enough to reduce tonnage for producing relatively high strain through the superalloy substrate, such as within about 100° C. of a delta solvus temperature.

In some examples, the forging temperature may be selected to reduce formation of one or more grain boundary phases of the superalloy. As explained above, in addition to forming strengthening phases at elevated temperatures, the strengthening phase formers may form other phases, such as the delta phases and eta phases. These phases may be incoherent with the gamma prime and double prime phases of the superalloy or may form relatively large grain boundaries. Formation of these phases may be related to particular temperatures or for particular amounts of time. For example, in an Inconel 718 substrate, a gamma double prime phase of $Ni_3Nb$ may transform to a delta phase, thereby reducing a strength of the substrate, while in an Inconel 718Plus substrate, a gamma prime phase of $Ni_3(Al/Ti)$ may transform to an eta phase. These transformations may be more likely at relatively intermediate temperatures.

As one example, FIG. 2 is a time-temperature-transformation diagram 20 of delta phase formation for Inconel 718+. As illustrated in diagram 20 of FIG. 2, delta phase precipitation may occur at a grain boundary (indicated by grain boundary curve 22), a twin boundary (indicated by twin boundary curve 24), or between grains (indicated by intragranular curve 26) at various temperatures after increasing amounts of times. However, for each type of precipitation curve 22, 24, or 26, relatively intermediate temperatures (e.g., 900-950° C.) may cause formation of the delta phase earlier than for relatively high (e.g., >950° C.) or relatively low temperatures (e.g., <900° C.). Diagram 20 includes a delta phase solvus temperature range, above which the delta phase may dissolve and below which the delta phase may precipitate. As such, a substrate maintained at intermediate temperatures may precipitate a greater volume fraction of the delta phase for a period of time than a substrate maintained at higher or lower temperatures. While not shown in FIG. 2, eta phase precipitation may be more likely to occur at intermediate temperatures than at higher temperatures closer to an eta solvus temperature. For example, as explained above, the eta phase and delta phase may be relatively similar in composition, with a slight difference in crystal structure, and often formation of one boundary phase will trigger precipitation or growth of another boundary phase. As such, a solvus temperature and various grain boundary curves for an eta phase may be relatively similar to a delta phase for temperature control of the substrate.

To reduce formation of the grain boundary phases of the substrate, such as the eta phase, the forging temperature range is configured to be below the eta phase solvus temperature of the substrate. This forging temperature range may be sufficiently high to enable grain refinement of the superalloy substrate through application of a plurality of die forging stages, as will be discussed further below, as well as limit precipitation of the grain boundary phases during grain refinement. In some examples, the eta phase solvus temperature is between about 980° C. and about 1010° C., such as about 990° C. However, the eta phase solvus temperature may vary depending on a composition of the superalloy substrate. In some examples, the forging temperature range is within about 100° C. of the eta solvus temperature. In some examples, the forging temperature range is between about 925° C. to about 950° C.

The method of FIG. 1 includes applying a plurality of die forging stages to the substrate to form a component preform (12). The plurality of die forging stages may be configured to shape the superalloy substrate into the component preform. In some examples, the plurality of die forging stages may be configured to sequentially refine the shape of the superalloy substrate. For example, the plurality of die forging stages may include one or more die forging stages configured to reduce a cross-section of the substrate and one or more die forging stages configured to refine a shape of the superalloy substrate.

In some examples, the plurality of die forging stages may be configured to refine a microstructure (e.g., grain size, shape, or distribution) of the superalloy substrate with reduced variability (i.e., increased uniformity). For example, the plurality of die forging stages may be configured to produce adequate strain through a cross-section of the component preform, such that a microstructure resulting from grain refinement is relatively uniform. A relatively uniform microstructure may include a grain size across the component preform that is within about 5 ASTM grain size units, such as within about 3 ASTM grain size units.

In some examples, the plurality of die forging stages may be configured to refine the microstructure of the superalloy substrate along at least two axes. Without being limited to any particular theory, application of high amounts of strain along an axis may cause delta and/or eta phase precipitates to change morphology (e.g., through deformation and/or dissolution breakage) to a more refined and/or distributed morphology. For example, eta phase precipitates may become mobile and align with forging flow perpendicular to application of a load, resulting in a finer morphology. As another example, delta phase precipitates may break up and form coarser, more distributed precipitates.

To produce grains that are refined in more than one direction, the plurality of die forging stages may be configured to apply a load along more than one axes. For example, during a first forging stage, such as a pancake forging stage or other stage configured to reduce a cross-section of the superalloy substrate in one or more directions and/or increase a cross-section of the substrate in another direction, a load may be applied along a first axis, such as a z-axis, such that local forging flow may be primarily along an x-y plane. In subsequent forging stages, such as a closed die forging stage or other forging stage configured to shape the superalloy substrate, a load may be applied along a second or third axis, such as an x-axis and/or y-axis, such that local forging flow may be primarily along planes other than an x-y plane. In this way, the plurality of die forging stages may refine the microstructure of the superalloy substrate along multiple axes through refinement of one or more grain boundary phases.

The method of FIG. 1 includes maintaining the substrate within the forging temperature range during application of the plurality of die forging stages (14). For example, a cross-section of the substrate may be maintained within the forging temperature range. By maintaining the substrate at the relatively high forging temperature range, precipitation of grain boundary phases may be reduced and/or controlled. For example, precipitation of the eta phase may be reduced, while precipitation of the delta phase may be reduced and controlled to inhibit grain growth during application of the plurality of die forging stages. In some examples, the substrate is maintained within the forging temperature range using at least one of die heating or adiabatic heating.

In some examples, particular portions of the superalloy substrate may be maintained at relatively high temperatures compared to other portions of the superalloy substrate. For example, a portion of the superalloy substrate may be maintained at the relatively high temperature to reduce a volume fraction of one or more boundary phases at the portions of the superalloy substrate (i.e., low grain boundary phase regions, such as a relatively low delta phase region or a relatively low eta phase region). In some examples, a volume fraction of a delta or eta phase in a relatively low delta phase region or relatively low eta phase region may be less than about 80% of an average volume fraction of the respective delta phase or eta phase in the superalloy substrate.

The method of FIG. 1 includes cooling the component preform (16). In some examples, the component preform may be cooled at a relatively high rate. For example, as the superalloy component preform remains at elevated temperatures, the eta phase may transform from a strengthening phase. To reduce an amount of time the component preform is within this temperature range, the component preform may be cooled sufficiently fast.

In some examples, the method of FIG. 1 includes processing the component preform to form a component. A variety of processing methods may be used including, but not limited to, machining, etching, and the like. In some examples, the component is at least one of an impeller or a disc.

In examples in which the component preform includes a relatively low gain boundary phase region, the component preform may be processed such that a high stress portion of the component is at least partially positioned within the relatively low grain boundary phase region. For example, a relatively low delta phase region may higher ductility or other mechanical properties than a relatively high delta phase region, such that portions of a component that are more subject to failure due to higher stresses may be machined into the relatively low delta phase region or regions.

Component preforms manufactured from the method described in FIG. 1 may include improved microstructure and mechanical properties. As one example, a component preform may include a relatively uniform strain across a cross-section of the component preform, such as an effective strain that varies between about 60% to about 200% across the component preform, or between about 80% and about 150% across the component preform. For example, this relatively uniform strain may be between about 0.6% and about 1.1% strain across the component preform after forging. As a result of this relatively uniform strain, the component preform may have a corresponding uniform microstructure, such as a grain size that varies less than about 5 ASTM units across the component preform. As another example, a component preform may include a relatively low volume fraction of grain boundary phase precipitates in the superalloy substrate, such as less than about 0.5 vol. % of a delta phase and an eta phase.

Figure 3:
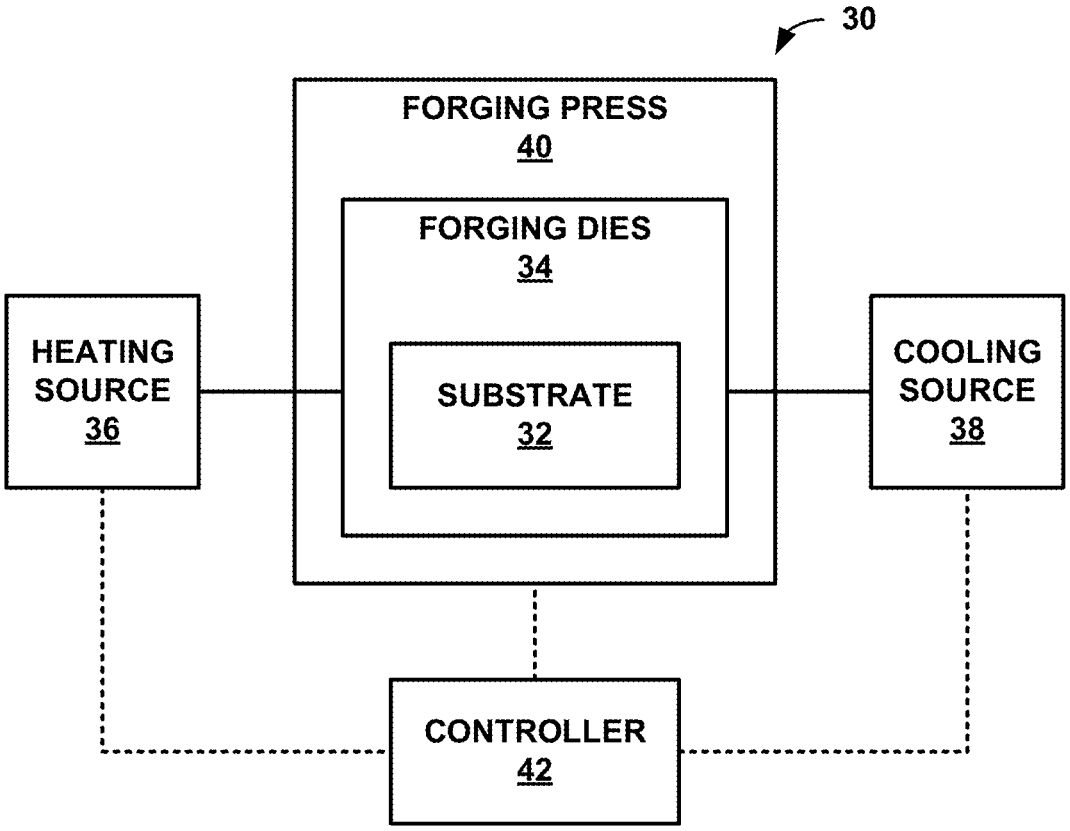
FIG. 3 is a conceptual and schematic diagram illustrating an example system for controlling microstructure in a superalloy substrate.

FIG. 3 is a conceptual and schematic diagram illustrating an example system 30 for controlling microstructure in a superalloy component. System 30 of FIG. 3 may be described with respect to the method of FIG. 1; however, system 30 may be used with other methods.

System 30 includes a plurality of sequential forging dies 34. The plurality of forging dies 34 may be configured to form a component preform from substrate 32. As explained in FIG. 1, substrate 32 includes a nickel-based superalloy. The plurality of forging dies 34 may be configured to apply refine a shape of substrate 32 and produce a relatively uniform strain in substrate 32 to refine a microstructure of substrate 32, such that substrate 32 may be processed into a component having a relatively low grain size. A variety of dies 34 may be used including, but not limited to, open dies, closed dies, and the like.

System 30 includes a forging press 40. Forging press 40 may be configured to apply a load to the plurality of sequential forging dies 34 in a plurality of die forging stages. For example, forging press 40 may be configured, in combination with the plurality of sequential forging dies 34, to produce sufficient strain in substrate 32 to refine a microstructure of substrate 32.

System 30 includes a heat source 36. Heat source 36 may be configured to heat substrate 32 to within a forging temperature range and maintain substrate 32 within the forging temperature range during application of the plurality of die forging stages. The forging temperature range is below an eta phase solvus temperature of the substrate. A variety of heat sources may be used including, but not limited to, die heating, adiabatic heating, and the like. In some examples, heat source 36 is a die heat source. For example, heat source 36 may include one or more heating elements in thermal contact with the plurality of sequential forging dies 34 and configured to heat substrate 32. While not shown, system 30 may include a furnace or other enclosure configured to provide an inert atmosphere. System 30 includes a cooling source 38 configured to cool the component preform formed from substrate 32. A variety of cooling sources may be used including, but not limited to air cooling, and the like.

System 30 includes controller 42. Controller 42 may be communicatively coupled to heat source 36, cooling source 38, and forging press 40. Controller 42 may include or may be one or more processors or processing circuitry, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some examples, the functionality of computing device 40 may be provided within dedicated hardware and/or software modules.

Controller 42 may be configured to control operation of system 30, including, for example, each of heat source 36, cooling source 38, and forging press 40 to implement the method of FIG. 1. Controller 42 may be configured to control heat source 36 to heat substrate 32 to within the forging temperature range and maintain substrate 32 within the forging temperature range during application of the plurality of sequential forging dies 34. For example, controller 42 may be configured to control heat source 36 based on a model of internal temperature of substrate 32. Controller 42 may be configured to control forging press 40 to apply the plurality of sequential forging dies 34 in a plurality of die forging stages. Controller 42 may be configured to control cooling source 38 to cool substrate 32.

FIGS. 4A-4I illustrate a plurality of die forging stages for making an example impeller 80 from a superalloy substrate 54. Superalloy substrate 54 may include any nickel-based superalloy substrate as described herein, such as the superalloy described in FIG. 1. Throughout the plurality of die forging stages of FIGS. 4A-4I, a temperature of the superalloy substrate and various superalloy preforms may be maintained within a forging temperature as described in FIG. 1, such that formation of grain boundary phases, such as the delta and/or eta phases, may be reduced.

In general, the plurality of die forging stages described in FIGS. 4A-4I may be configured to apply adequate strain across a cross-section of a substrate, such that a microstructure of the substrate may be relatively uniform. For example, an initial substrate may be sequentially shaped by dies that are configured to produce a relatively uniform effective strain while enabling sufficient heat transfer and/or generation, such as through die or adiabatic heating, to maintain the substrate within the forging temperature range. In some examples, the plurality of die forging stages may be configured to shape the substrate such that portions of the substrate having particular properties, such as low volume fraction of grain boundary phases, may be positioned in particular portions of the resulting component preform.

Figure 4A:
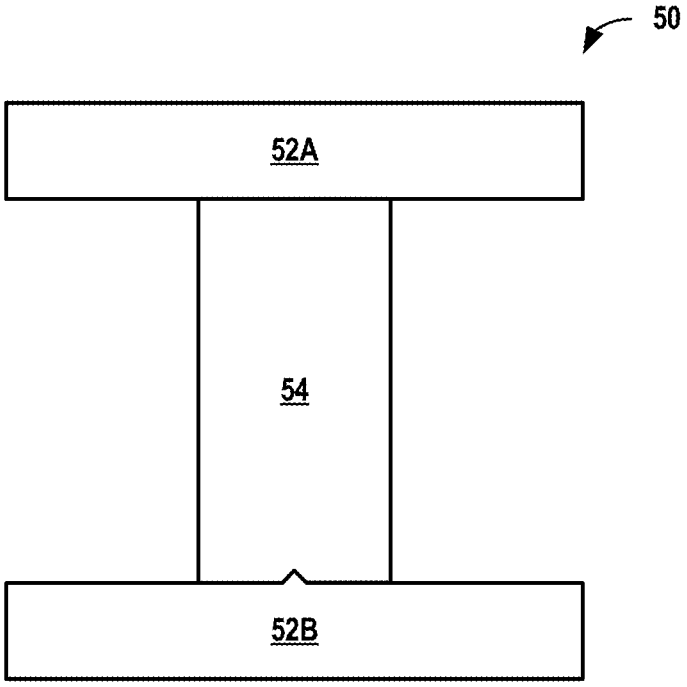
FIGS. 4A and 4B are side view cross-sectional diagrams illustrating a first forging stage for an impeller made from a superalloy substrate.
Figure 4B:
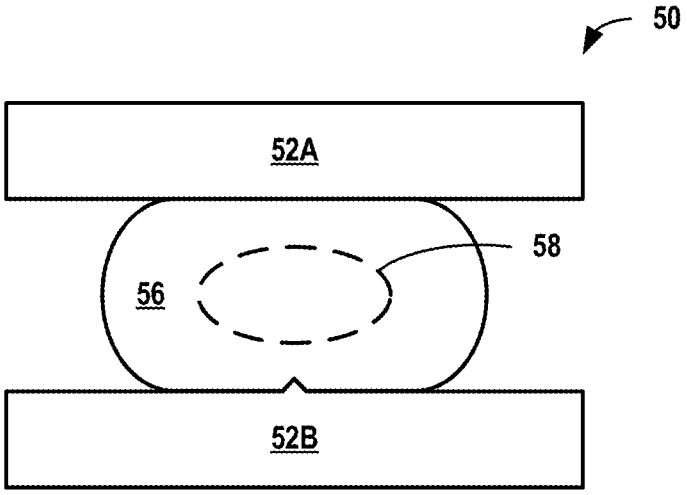

FIGS. 4A and 4B are side view cross-sectional diagrams illustrating a first forging stage 50 for an impeller made from a superalloy. First forging stage 50 may be an open die forging stage. In the example of FIGS. 4A and 4B, first forging stage 50 is illustrated as a pancake forging stage configured to reduce a cross-section of substrate 54; however, other types of die forging may be used.

Referring to FIG. 4A, substrate 54 may be positioned between two open dies 52A and 52B. In some examples, dies 52A and 52B may include one or more heating elements, such that dies 52A and 52B may assist in maintaining substrate 54 within the forging temperature range during first forging stage 50. A first load, such as from a forging press, may be applied to one or both of dies 52A and 52B to deform substrate 54.

Referring to FIG. 4B, substrate 54 has been deformed to rough substrate 56. Rough substrate 56 may include a region 58 of relatively low volume fraction of one or more grain boundary phases, such as the delta or eta phases ("low grain boundary phase region 58"). For example, low grain boundary phase region may have a volume fraction that is less than about 80% of a volume fraction of an average volume fraction of the corresponding grain boundary phase in rough substrate 56. As will be illustrated in FIGS. 4C-4I, low grain boundary phase regions in substrate 54 may be maintained and further refined, such that a resulting impeller includes a relatively low volume fraction of the grain boundary phase at portions of the impeller undergoing relatively high stresses.

Figure 4C:
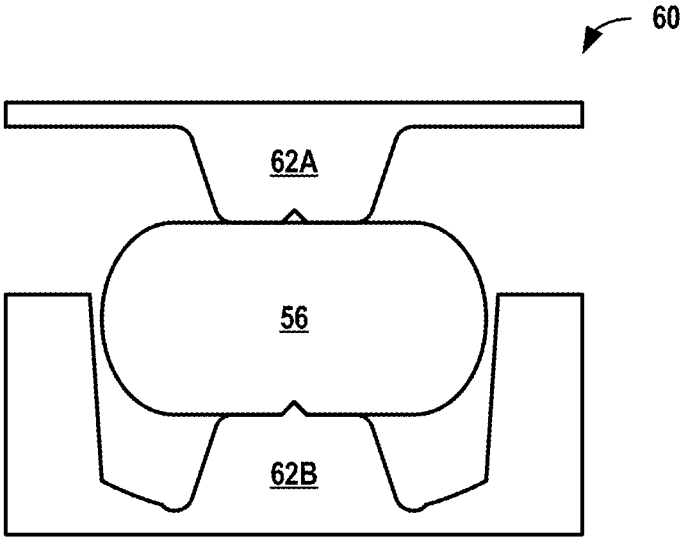
FIGS. 4C-4E are side view cross-sectional diagrams illustrating a second forging stage for an impeller made from a superalloy substrate.
Figure 4D:
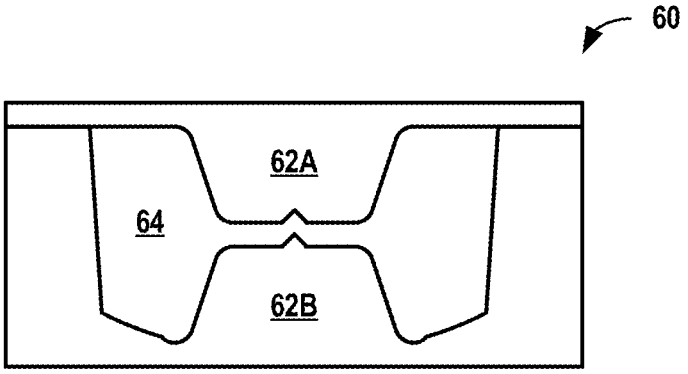
Figure 4E:
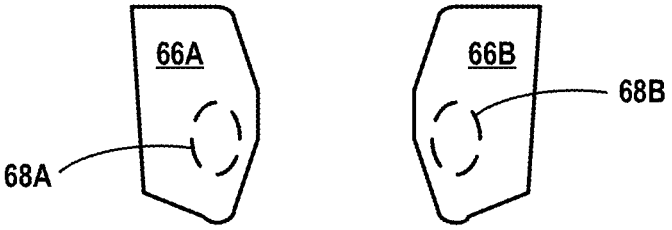

FIGS. 4C-4E are side view cross-sectional diagrams illustrating a second forging stage 60 for an impeller made from a superalloy. In the example of FIGS. 4A and 4B, second forging stage 60 is illustrated as a closed die forging stage configured to divide and shape rough substrate 56, such that a portion of rough substrate 56 near a center of rough substrate 56 may be positioned off-center of a resulting preform substrate 66; however, other types of die forging may be used.

Referring to FIG. 4C, substrate 54 may be positioned between two closed dies 62A and 62B. In some examples, dies 62A and 62B may include one or more heating elements, such that dies 62A and 62B may assist in maintaining substrate 54 within the forging temperature range during second forging stage 60. A second load, such as from a forging press, may be applied to one or both of dies 62A and 62B to deform rough substrate 56. Referring to FIG. 4B, rough substrate 56 has been deformed to preform substrate 64.

Referring to FIG. 4E, preform substrate 64 may be further processed to divide preform substrate 64 and form first preform substrate 66A and second preform substrate 66B. Each of first and second preform substrates 66A and 66B may include a respective region 68A and 68B of relatively low volume fraction of one or more grain boundary phases, such as the delta or eta phases ("low grain boundary phase regions 68"). For example, low grain boundary phase regions 68 may each have a volume fraction that is less than about 80% of a volume fraction of an average volume fraction of the corresponding grain boundary phase in preform substrates 66.

In some examples, second forging stage 60 may be configured such that processing conditions corresponding to a relatively low volume fraction of grain boundary phases, such as relatively high temperature, may be maintained in an overlapping region between first forging stage 50 and second forging stage 60. For example, low grain boundary phase region 68 of second forging stage 60 may at least partially overlap with low grain boundary phase region 58 of first forging stage 50.

Figure 4F:
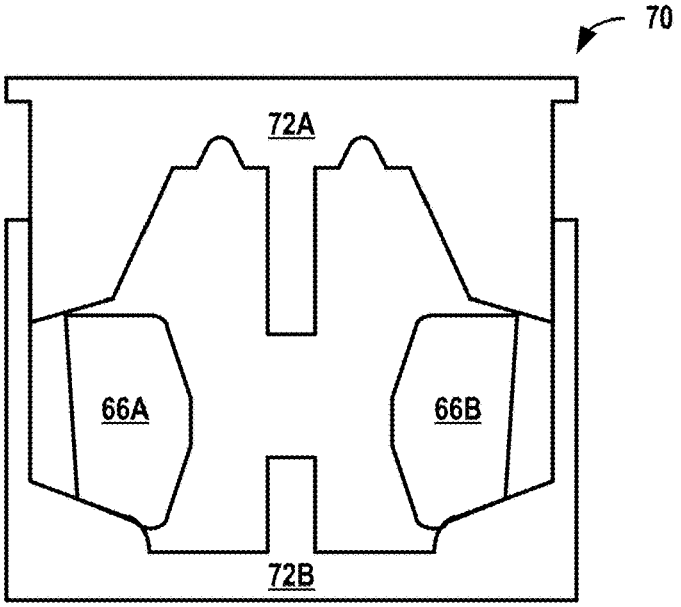
FIGS. 4F-4H are side view cross-sectional diagrams illustrating a third forging stage for an impeller made from a superalloy substrate.
Figure 4G:
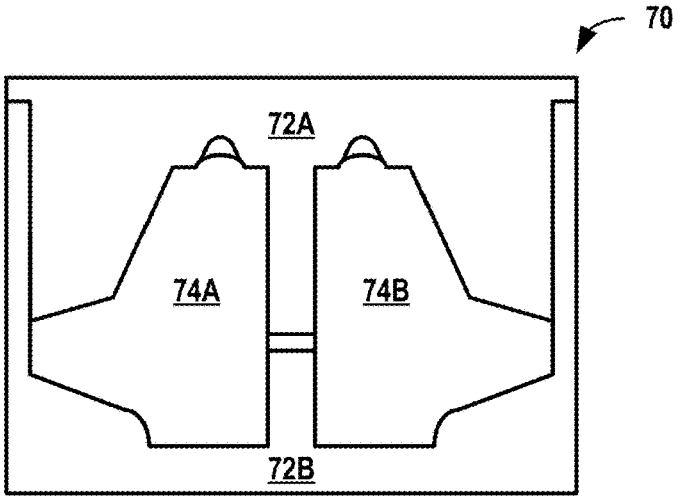
Figure 4H:
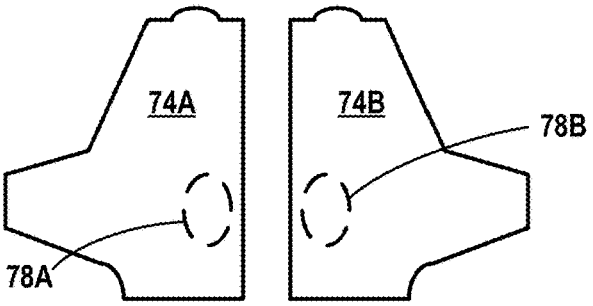

FIGS. 4F-4H are side view cross-sectional diagrams illustrating a third forging stage 70 for an impeller made from a superalloy. In the example of FIGS. 4A and 4B, third forging stage 70 is illustrated as a closed forging stage configured to shape preform substrate 66 into a finished substrate 74 representing a component preform suitable for processing into an impeller 80; however, other types of die forging may be used.

Referring to FIG. 4F, preform substrates 66A and 66B may be positioned between two closed dies 72A and 72B. In some examples, dies 72A and 72B may include one or more heating elements, such that dies 72A and 72B may assist in maintaining preform substrate 66 within the forging temperature range during third forging stage 70. A third load, such as from a forging press, may be applied to one or both of dies 72A and 72B to deform preform substrates 66A and 66B. Referring to FIG. 4G, preform substrates 66A and 66B have been deformed to finished first and second substrates 74A and 74B, respectively.

Referring to FIG. 4H, each of first and second finished substrates 74A and 74B may include a respective region 78A and 78B of relatively low volume fraction of one or more grain boundary phases, such as the delta or eta phases ("low grain boundary phase regions 78"). For example, low grain boundary phase regions 78 may each have a volume fraction that is less than about 80% of a volume fraction of an average volume fraction of the corresponding grain boundary phase in finished substrates 74.

Figure 4I:
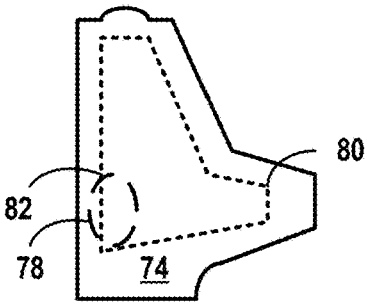
FIG. 4I is a side view cross-sectional diagram illustrating a post-processing stage for an impeller made from a superalloy substrate.

FIG. 4I is a side view cross-sectional diagram illustrating a post-processing stage for an impeller made from a superalloy. A finished substrate 74 may be an impeller preform that may be further machined to form an impeller 80. Impeller 80 includes a bore 82 that may experience relatively high stresses. To impart additional mechanical strength on bore 82, finished substrate 74 may be machined into impeller 80 such that a low grain boundary phase region 78 may be substantially aligned with bore 82. For example, by having a lower volume fraction of the grain boundary phases, low grain boundary phase region 78 may have increased ductility or other improved mechanical properties. In this way, impeller 80 may have improved mechanical properties in portions of impeller 80 subject to higher stresses.

While FIGS. 4A-4I have been described with respect to forming an impeller, the plurality of die forging stages may be configured to form a variety of different components. As another example, a high pressure turbine disc may experience relatively high stresses near a bore, such that two die forging stages—an open, upsetting die forging stage and finishing, closed die forging stage—may be used. A temperature of the two die forging stages may be maintained such that formation of grain boundary phases near a center of a substrate corresponding to the bore may be reduced.

FIGS. 5A-6E are example simulated diagrams illustrating various properties of an example impeller preform, including various intermediate preforms. Unless otherwise indicated, the various preforms may correspond to preforms formed using the die forging stages illustrated in FIGS. 4A-4I.

Figure 5A:
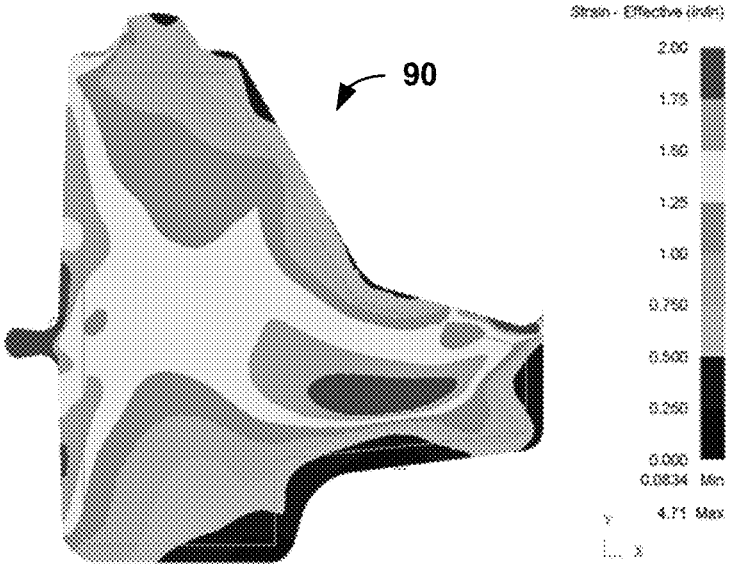
FIG. 5A is a side view cross-sectional diagram illustrating strain for an impeller preform made from a superalloy substrate using a single forging stage.

FIG. 5A is a side view cross-sectional diagram illustrating strain for an impeller preform 90 made from a superalloy after a single forging stage. An impeller formed from impeller preform 90 is shown superimposed. Impeller preform 90 has high variability in strain, including a relatively high strain region near a rim of an impeller and a relatively moderate strain region near a bore of the impeller.

Figure 5B:
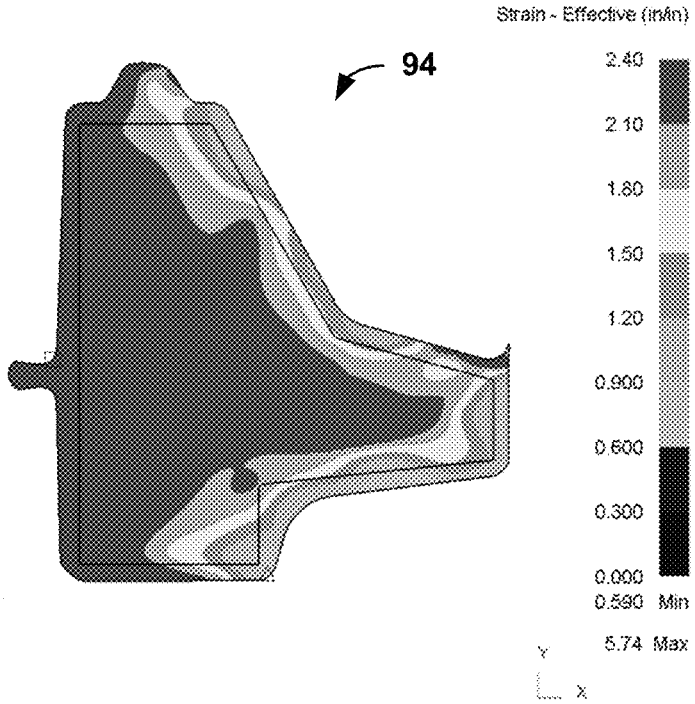
FIG. 5B is a side view cross-sectional diagram illustrating strain for an impeller preform made from a superalloy substrate using multiple forging stages.

Rather than use a single die forging stage, which may create the varied strain across a component preform as illustrated in FIG. 5A, methods described herein may use a multiple stage die forging process to create high and relatively uniform strain across a component preform. FIG. 5B is a side view cross-sectional diagram illustrating strain for an impeller preform 94 made from a superalloy after multiple forging stages, such as the die forging stages illustrated in FIGS. 4A-4I. Impeller preform 94 has a more uniform strain across impeller preform 94, including regions corresponding to an impeller (not shown). For example, a region corresponding to a bore of the impeller has substantially higher strain than a region corresponding to a rim of the impeller.

Figure 5C:
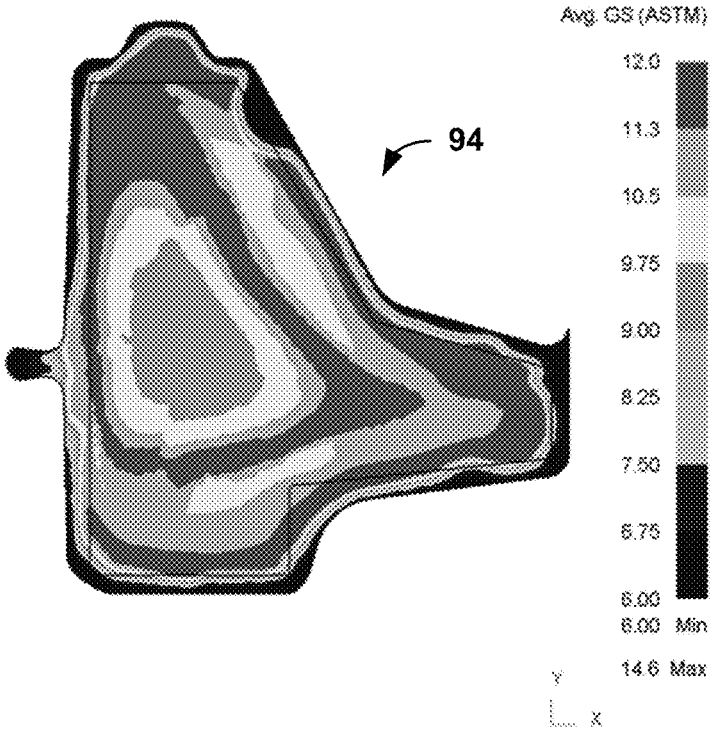
FIG. 5C is a side view cross-sectional diagram illustrating grain size for an impeller preform made from a superalloy substrate using multiple forging stages.

The relatively high strain of impeller preform 94 may assist in creating a refined microstructure, such as evidenced by a relatively low and/or uniform grain size. FIG. 5C is a side view cross-sectional diagram illustrating grain size for impeller preform 94 made from a superalloy after multiple forging stages. While impeller preform 94 may include a relatively high grain size near a center of impeller preform 94, this relatively high grain size region is still relatively similar (e.g., within about 3 ASTM size units) from relatively low grain size regions. For example, a region corresponding to a bore of an impeller has a relatively low grain size of about 10 ASTM units.

Figure 5D:
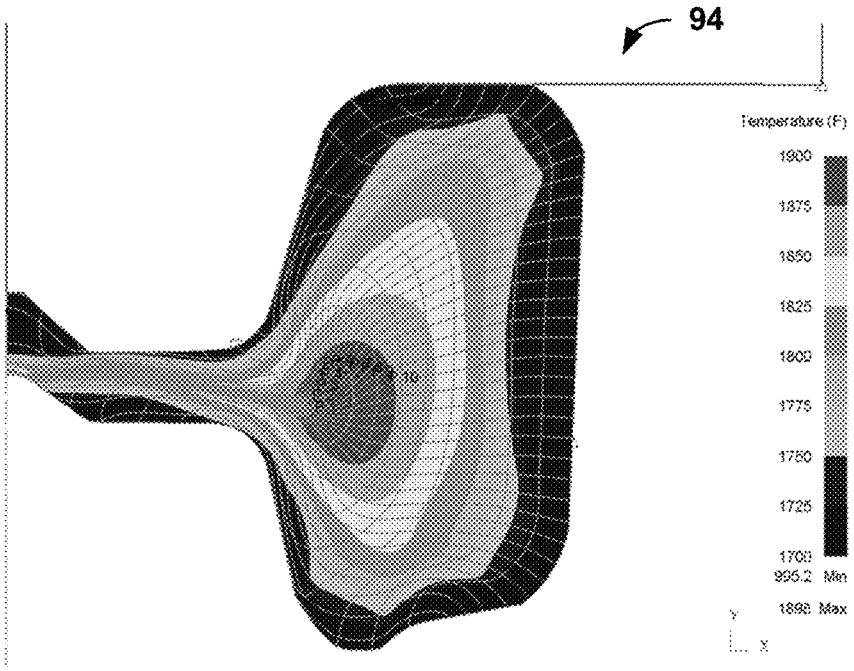
FIG. 5D is a side view cross-sectional diagram illustrating temperature for an intermediate substrate for an impeller made from a superalloy substrate after multiple forging stages.

As explained above, a microstructure of the superalloy may be influenced by grain size and precipitation of grain boundary phases. Precipitation of grain boundary phases, such as the eta phase, may be reduced by maintaining relatively high temperature during the plurality of die forging stages. FIG. 5D is a side view cross-sectional diagram illustrating temperature for an preform substrate 98 for an impeller made from a superalloy after multiple forging stages, such as illustrated in FIG. 4E. A temperature of preform substrate 98 increases from a center of preform substrate 98 to an outer surface. For example, a region of preform substrate 98 corresponding to a bore of an impeller (not shown) may have a temperature that is near or at an eta phase solvus temperature, such that formation of the eta phase may be reduced at this region.

A volume fraction of delta phase that forms in a component preform may be related to a temperature of the component preform and the strain of the component preform. However, as illustrated in FIG. 5D, a temperature of the component preform may vary across a cross-section of the component preform. A volume fraction of grain boundary phases, such as the delta phase, may also vary across the component preform. Portions of the component preform subject to, and maintained at, higher temperatures above the nose of the grain boundary precipitation curve may include a lower volume fraction of grain boundary phases, such as the delta phase, than other portions of the component preform subject to lower temperatures. A temperature of the component preform may be influenced by conduction or convection from surrounding heating sources, as well as heat generated from strain.

While FIGS. 6A-6E will be described with respect to a delta phase of the superalloy preforms, the principles described may also apply to an eta phase of the superalloy preforms. For example, maintaining an elevated temperature throughout the various superalloy preforms near to an eta phase and/or delta phase may reduce precipitation of grain boundary phases generally, though various mechanisms and kinetics of the eta phase and delta phase may vary.

Figure 6A:
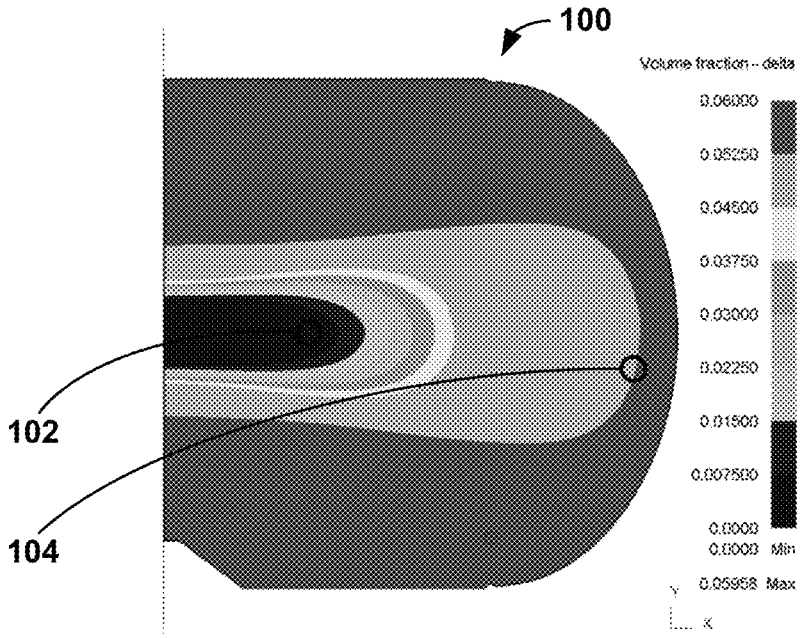
FIG. 6A is a side view cross-sectional diagram illustrating volume fraction of a delta phase for a rough substrate for an impeller made from a superalloy substrate after a first forging stage.

FIG. 6A is a side view cross-sectional diagram illustrating volume fraction of a delta phase for a rough substrate 100 for an impeller made from a superalloy after a rough forging stage, such as described in FIGS. 4A and 4B. A volume fraction of a delta phase of the superalloy in rough substrate 100 may increase radially from an outer surface of rough substrate 100 to an interior. A region 102 of rough substrate 100 corresponding to a bore of the impeller ("bore region 102") may have a relatively low volume fraction (e.g., >0.01) of the delta phase, while a region 104 of rough substrate 100 corresponding to a rim of the impeller ("rim region 104") may have a relatively high (e.g., >0.05) volume fraction of the delta phase.

Figure 6B:
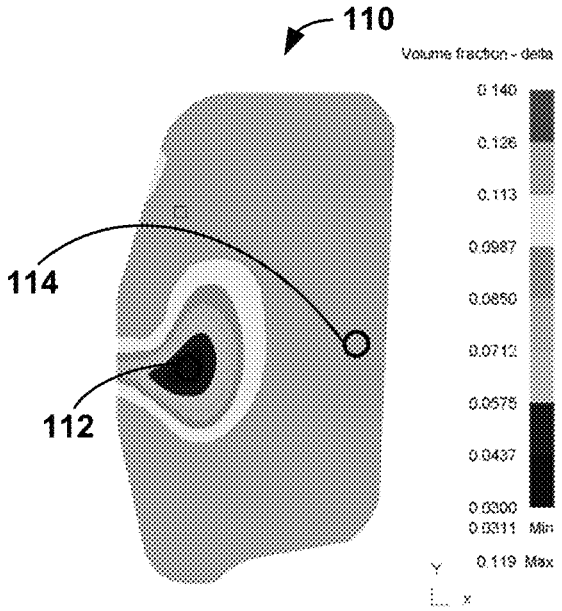
FIG. 6B is a side view cross-sectional diagram illustrating volume fraction of a delta phase for a preform substrate for an impeller made from a superalloy substrate after a second forging stage.

FIG. 6B is a side view cross-sectional diagram illustrating volume fraction of a delta phase for a preform substrate 110 for an impeller made from a superalloy after a preform forging stage, such as described in FIGS. 4C and 4D. A region 112 of preform substrate 110 corresponding to a bore of the impeller ("bore region 112") may have a relatively low (e.g., <0.04) volume fraction of the delta phase, while a region 114 of preform substrate 110 corresponding to a rim of the impeller ("rim region 114") may have a relatively high (e.g., >0.1) volume fraction of the delta phase.

Figure 6C:
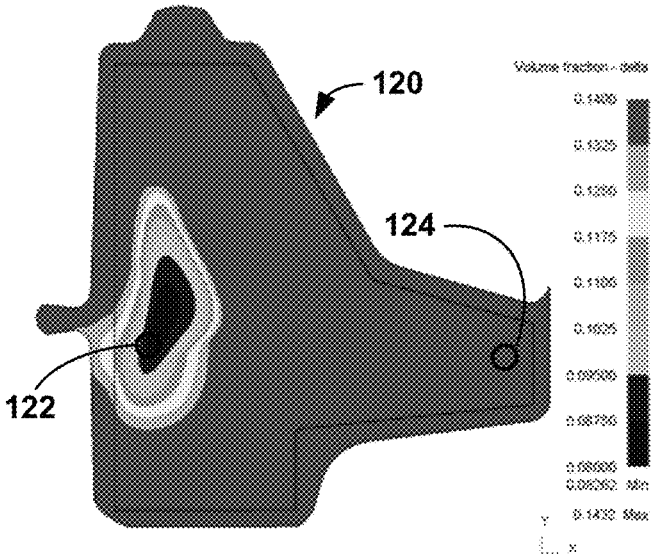
FIG. 6C is a side view cross-sectional diagram illustrating volume fraction of a delta phase for a finish substrate for an impeller made from a superalloy substrate after a third forging stage.

FIG. 6C is a side view cross-sectional diagram illustrating volume fraction of a delta phase for a finished substrate 120 for an impeller made from a superalloy after a finish forging stage. A region 122 of finished substrate 120 corresponding to a bore of the impeller ("bore region 122") may have a relatively low (e.g., <0.09) volume fraction of the delta phase, while a region 124 of finished substrate 120 corresponding to a rim of the impeller ("rim region 124") may have a relatively high (e.g., >0.14) volume fraction of the delta phase. Finish substrate 120 may be an impeller preform from which the impeller may be machined, such that bore region 122 corresponds to a portion of a bore of the impeller and rim region 124 corresponds to a portion of a rim of the impeller.

Figure 6D:
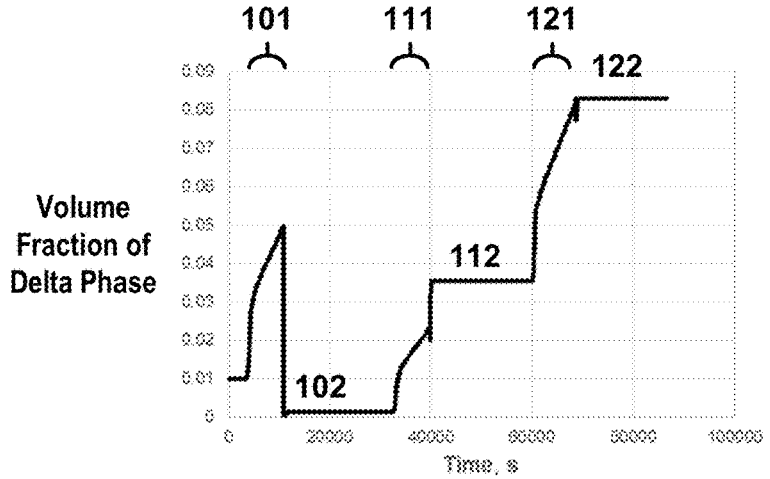
FIG. 6D is a graph of a volume fraction of a delta phase for a bore region of substrates over a period of time corresponding to FIGS. 6A-6C.
Figure 6E:
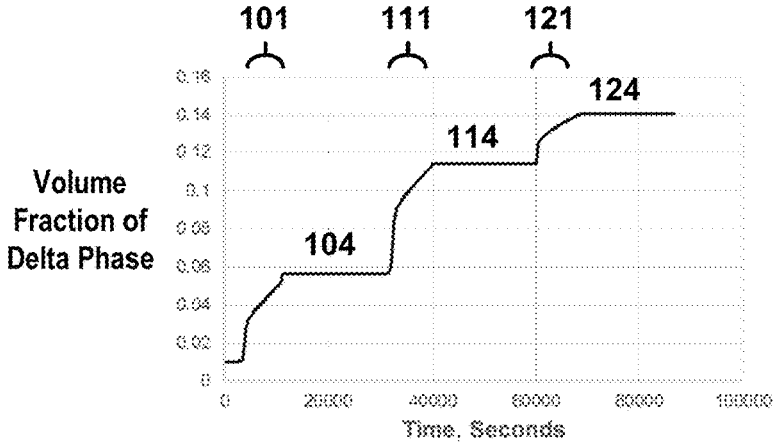
FIG. 6E is a graph of a volume fraction of a delta phase for a rim region of substrates over a period of time corresponding to FIGS. 6A-6C.

FIGS. 6D-6E are graphs illustrating a volume fraction of a delta phase for bore regions 102, 112, 122 and rim regions 104, 114, 124 for a rough forging stage 101, a preform forging stage 111, and a finish forging stage 121 described in FIGS. 6A, 6B, and 6C, respectively.

FIG. 6D is a graph of a volume fraction of a delta phase for bore regions 102, 112, 122 of impeller substrates 100, 110, 120 over a period of time corresponding to FIGS. 6A-6C. A first forging stage may include deforming substrate 100 to form the delta phase of bore region 102, such as by forming, and subsequently dissolving, the delta phase. However, in other examples, a temperature of bore region 102 may be below a delta solvus temperature. A second forging stage may include further deforming substrate 110 to form the higher volume fraction of the delta phase of bore region 112. A third forging stage may include further deforming substrate 120 to form the higher volume fraction of the delta phase of bore region 122.

FIG. 6E is a graph of a volume fraction of a delta phase for rim regions 104, 114, 124 of impeller substrates 100, 110, 120 over a period of time corresponding to FIGS. 6A-6C. A first forging stage may include deforming substrate 100 to form the delta phase of rim region 104. Unlike bore region 102, rim region 104 may not reach a delta solvus temperature, such that the delta phase may not dissolve. A second forging stage may include further deforming substrate 110 to form the higher volume fraction of the delta phase of rim region 114. A third forging stage may include further deforming substrate 120 to form the higher volume fraction of the delta phase of rim region 124.

Various examples have been described. These and other examples are within the scope of the following claims.

What is claimed is:

1. A method comprising:

heating a substrate to within a forging temperature range, wherein the substrate comprises a nickel-based superalloy, and wherein the forging temperature range is below a grain boundary phase solvus temperature of the substrate;

applying a plurality of die forging stages to the substrate to form a component preform;

maintaining the substrate within the forging temperature range during and between application of each of the plurality of die forging stages; and cooling the component preform after completing the plurality of die forging stages, wherein a portion of the component preform includes a relatively low delta phase region, and wherein a volume fraction of a delta phase in the relatively low delta phase region is less than 80% of an average volume fraction of the delta phase in the component preform; and processing the component preform to form a component, wherein the component includes a relatively high stress portion relative to other portions of the component, and wherein the relatively high stress portion of the component is at least partially positioned within the relatively low delta phase region.

2. The method of claim 1, wherein the grain boundary phase solvus temperature is an eta phase solvus temperature.

3. The method of claim 2, wherein the forging temperature range is within 100° C. of the eta solvus temperature.

4. The method of claim 1, wherein the component comprises at least one of an impeller, a low pressure turbine disc, or a high pressure turbine disc.

5. The method of claim 1, wherein the component preform has an effective strain that varies between 60% and 200% across the component preform.

6. The method of claim 1, wherein the component preform has a grain size that varies less than about 5 ASTM units across the component preform.

7. The method of claim 1, wherein the plurality of die forging stages is configured to refine a grain of the superalloy substrate along at least two axes.

8. The method of claim 1, wherein the substrate comprises niobium, aluminum, and titanium.

9. The method of claim 8, wherein the substrate has a composition comprising between 12 wt. % and 20 wt. % chromium, between 6 wt. % and 14 wt. % iron, between 5 wt. % and 12 wt. % cobalt, between 4 wt. % and 8 wt. % niobium, less than 6 wt. % tungsten, less than 4 wt. % molybdenum, between 0.6 wt. % and 2.6 wt. % aluminum, between 0.4 wt. % and 1.4 wt. % titanium, less than 0.1 wt. % carbon, between 0.003 wt. % and 0.03 wt. % phosphorus, between 0.003 and 0.015 wt. % boron, and wherein the forging temperature range is between 925° C. and 1010° C.

10. The method of claim 1, wherein the substrate is maintained within the forging temperature range using at least one of die heating or adiabatic heating.

* * * * *